United States Patent [19]

Register

[11] Patent Number: 4,473,320

[45] Date of Patent: Sep. 25, 1984

[54] PAVEMENT RESURFACING DEVICE

[76] Inventor: Archie J. Register, P.O. Box 112, San Augustine, Tex. 75972

[21] Appl. No.: 300,272

[22] Filed: Sep. 8, 1981

[51] Int. Cl.[3] ..... E21C 19/05; E21C 23/12

[52] U.S. Cl. ..... 404/91; 404/75; 404/92; 404/101

[58] Field of Search ..... 404/90, 91, 92, 101, 404/108, 75; 299/39, 41, 14

[56] References Cited

U.S. PATENT DOCUMENTS

| | | | |
|---|---|---|---|
| 1,354,076 | 9/1920 | Stephens | 404/91 |
| 1,938,755 | 12/1933 | Swearingen | 404/91 |
| 2,201,493 | 5/1940 | Jorgensen | 404/91 X |
| 2,211,262 | 8/1940 | Flynn | 404/91 |
| 2,394,017 | 2/1946 | Seaman | 404/91 X |
| 2,546,907 | 3/1951 | Sherwood | 404/91 |
| 2,619,013 | 11/1952 | McEachran . | |
| 2,643,868 | 6/1953 | Covington . | |
| 2,747,475 | 5/1956 | West | 404/91 |
| 3,361,042 | 1/1968 | Cutler . | |
| 3,375,764 | 4/1968 | Petersen . | |
| 3,510,073 | 5/1970 | Mailliard | 404/91 X |
| 3,561,335 | 2/1971 | Leatherman | 404/91 X |
| 3,732,023 | 5/1973 | Rank . | |
| 3,767,264 | 10/1973 | Eckey | 299/39 |
| 3,825,361 | 7/1974 | Steiner | 299/41 X |
| 3,843,274 | 10/1974 | Gutman et al. . | |
| 3,989,401 | 11/1976 | Moench . | |
| 4,011,023 | 3/1977 | Cutler . | |
| 4,124,325 | 11/1978 | Cutler . | |
| 4,172,679 | 10/1979 | Wirtgen | 299/39 X |
| 4,185,875 | 1/1980 | Swisher . | |
| 4,195,946 | 4/1980 | Swisher | 299/39 X |
| 4,226,552 | 10/1980 | Moench . | |

OTHER PUBLICATIONS

Fifteen advertisements for road finishing machinery.
Eight brochures and excerpts from publications relating to road finishing machinery.

*Primary Examiner*—Ernest R. Purser
*Attorney, Agent, or Firm*—Arnold, White & Durkee

[57] ABSTRACT

A method and apparatus are disclosed for resurfacing the paved area in a continuous operation. The apparatus includes means for planing a surface layer of the paved area to provide crushed particle material of a suitable size. An aggregate dispensing system is included for continuously depositing a predetermined quantity of aggregate onto the area to be resurfaced. A binary dispensing system adds binder to the crushed particle material and the aggregate which is then mixed by mixing system to form a new surfacing mixture at the site. The surfacing mixture is then spread and compacted by a surfacing mixture distribution system in order to form a usable surface layer.

23 Claims, 4 Drawing Figures

PAVEMENT RESURFACING DEVICE

BACKGROUND OF THE INVENTION

The invention relates generally to pavement resurfacing devices and more particularly, it concerns an improved method and device for repaving which planes the surface and forms a new surfacing mixture for depositing over the planed surface in a continuous operation.

Heavy machinery has long been used to rework deteriorating roads. In the past, numerous machines were utilized to resurface a given section of road. Typically, however, the section of road being worked upon could not carry traffic for several days during resurfacing, thereby necessitating a rerouting of traffic.

Attempts have been made, though, to simplify the procedure for resurfacing a road by either streamlining the process through a series of steps each utilizing a separate machine or through the use of a single machine designed to perform multiple functions. Typically, these attempts have included the addition of heat to the road bed prior to removing the original surface layer or the addition of a special hot mix to the road upon the resurfacing of the road or both. Also, the roadbed is often crushed and picked up for processing.

One example of a method and apparatus for treating asphaltic pavement in a series of treatments performed by several machines is disclosed in U.S. Pat. No. 4,226,552 to Moench. A single apparatus road surfacing machine is disclosed in U.S. Pat. No. 3,361,042 to Cutler. The method disclosed in Cutler '042 includes the step of heating the road bed prior to scarification. Further, the apparatus claimed in Cutler '042 incudes a conveyor means for depositing "hot mix" selectively.

Another patent to Cutler, U.S. Pat. No. 4,011,023, discloses a method and apparatus for recycling asphalt pavement. The method includes the steps of picking up crumbled pavement and heating and treating the pavement and surface before redepositing the mixture.

U.S. Pat. No. 4,124,352 to Cutler discloses a method and apparatus for recycling asphalt pavement. It is believed that this method and apparatus contemplates the use of heat on the roadway and the addition of new hot mix to form a new surfacing mixture.

It should be noticed that each of the devices and methods disclosed in the prior patents either apply heat to the road prior to scarification or pick up the roadbed to heat it and prepare it for reapplication or add a prepared asphalt mixture to the road bed prior to relaying the road.

Other devices which similarly apply heat include U.S. Pat. No. 3,843,274 to Gutman and U.S. Pat. No. 3,989,401 to Moench. U.S. Pat. No. 2,619,013 to McEachran discloses a device which picks up scarified roadbed and reworks it. U.S. Pat. No. 3,732,023 to Rank discloses a soil stabilization apparatus which mixes pulverized asphalt and asphalt/concrete surfaces with lime, cement, or emulsified asphalt to create a stabilized base for the new roadway.

Hence, to provide an iproved method and apparatus for recycling pavement, it is necessary to provide a method and apparatus which avoids the application of heat, the lifting of the road surface to a special container for retreating, or the addition of specially formulated materials to form the new road surface.

SUMMARY OF THE INVENTION

The present invention overcomes the prior disadvantages through an apparatus for resurfacing a paved area which includes a main chassis adapted to be driven over the paved area. A planer is mounted on the chassis and adapted to be driven to plane a surface layer of the paved area to provide particle material of a desired size. An aggregate dispenser is operatively associated with the chassis and is adapted to add a selective quantity of aggregate to the paved area. A binder dispensing system is further mounted on the chassis and is adapted to add a predetermined quantity of a binding agent to the aggregate and particle material. A mixing system is additionally mounted on the chassis and is positioned and adapted to mix the binding agent, the aggregate and the particle material to form a surfacing mixture. The apparatus further includes a surfacing mixture distribution system mounted on the chassis wherein the mixture distribution system spreads the mixture to a desired width and profile to form a fresh surface layer.

In a preferred aspect of the present invention, the planer may include a positioner adapted to the chassis to provide vertical adjustment of the planer to accommodate the planing of selective depths of the paved area. The planer may further be comprised of a drum having a plurality of teeth selectively positioned for planing the surface layer to provide particle material of a desired size. The drum may typically be adapted to rotate along a substantially horizontal axis substantially transverse to the usual direction of movement of the chassis. The positioner may then include an actuating cylinder adapted between the drum and the chassis to accommodate vertical adjustment of the drum to selectively provide the desired depth of cut.

The planer may further be adapted to provide adjustability for the width of cut. In particular, the planer may include an axle movably mounted to the chassis to permit rotation of the axle around a substantially horizontal axis substantially transverse to the usual direction of movement of the chassis. A central cylindrical drum is axially disposed around and secured to the axle wherein the drum includes a plurality of teeth selectively positioned for planing the surface layer to provide particle material of a desired size. The planer further includes a removable cylindrical drum axially disposed and detachably secured to the axle wherein the removable cylindrical drum is positioned longitudinally adjacent the central cylindrical drum. If desired, removable cylindrical drums may be provided on either side of the central cylindrical drum. The removable cylindrical drums typically each include a plurality of teeth selectively positioned for planing the surface layer to provide a particle material of a desired size. Accordingly, adjustability of the width of cut may be provided by removing or adding the removable cylindrical drums as desired.

The aggregate dispenser of the present invention may be adapted to deposit a selective quantity of aggregate onto the paved surface either prior to the planing of the surface layer of the paved surface or after the planing of the surface layer. If the aggregate is deposited prior to the planing of the surface layer, the size of the aggregate is not critical because the crushing and planing of the surface layer of the paved area to a given particle size will automatically cause the crushing of the aggregate to a similar particle size, as well as begin the mixing of the old and new material. If the aggregate is deposited after the planing of the surface layer, however, the aggregate should include material of a preselected particle size suitable for refinishing the roadbed.

In a preferred aspect of the present invention, the aggregate dispenser comprises a dispensing chassis operatively secured to the main chassis of the repaving apparatus. The two chassis are secured such that relative movement between the two are accommodated for irregularities and variations in the surface of the paved area and for changes in the direction of travel of the two vehicles. An aggregate container is secured to the dispensing chassis having dimensions adequate to hold a desired quantity of aggregate. A measured dispensing system communicates with the container for selectively dispensing a predetermined quantity of aggregate.

The binder dispensing system of the present invention may typically include a reservoir secured to the main chassis for holding a binding agent or adhesive such as asphalt. A spray bar is secured on the underside of the chassis in communication with the reservoir and has at least one opening for distributing binder. The spray bar is positioned such that the binder is dispensed on aggregate and particle material residing on the ground. The binder dispensing system may further include a means for pumping a metered quantity of such a binding agent from the reservoir out of the spray bar under pressure.

In a preferred aspect of the present invention, the binder dispensing system further includes a means positioned in the reservoir for heating the binder in order to maintain the binder at a suitable temperature and in a suitable form for application to the aggregate and particle material. For those embodiments including an internal combustion engine for powering the apparatus, the pipes from the exhaust system may be utilized as a means for heating the binder.

The mixing system of the present invention may include a means for gathering the aggregate and particle material into a windrow and a mixer positioned relative to the aggregate dispenser, the planer and the binder dispensing system such that the mixer mixes the aggregate, particle material and binder after the three have been deposited onto the roadbed in order to form a new surfacing mixture. The means for gathering the aggregate and particle material into a windrow may include an auger rotatably mounted to the chassis to be driven around a substantially horizontal axis positioned substantially transverse to the direction of travel of the chassis wherein the auger rotates to gather the particle material and aggregate into a windrow.

In the preferred embodiment, the mixing system further includes a plurality of mixers wherein each mixer is adapted to be driven around a substantially horizontal axis to mix the particle material, aggregate and binder to form a surfacing mixture.

The surfacing mixture distribution system may include a spreading auger rotationally mounted to the chassis. The auger is adapted to be driven around a substantially horizontal axis to spread the surfacing mixture to a desired width over the planed area. The surfacing mixture distribution system may further include a leveling blade adjustably secured to the chassis and disposed such that the leveling blade may be adjusted to level the mixture spread by the spreading auger to a desired profile.

In a preferred aspect of the present invention, the surfacing mixture distribution system further includes a screed detachably mounted proximate the rear of the chassis for screeding the leveled mixture. The screed may be detachably secured to the chassis for removal during those road surfacing operations wherein a separate means of compacting the mixture is desired or a different means of handling the mixture is desired.

The apparatus of the present invention may further include a power means for driving the chassis and the systems mounted thereon. Typically, this power means will include a suitable internal combustion engine, such as a propane or diesel engine, with related gear and control mechanisms. It will be apparent, however, that other power means may be utilized in accordance with the present invention.

The present invention also includes a novel method of resurfacing a paved area in a continuous operation. The method includes the steps of planing the surface layer of such a paved area to provide particle material of a suitable size. Either prior to or immediately after planing, a predetermined quantity of aggregate is deposited onto the area to be resurfaced in order to provide additional aggregate material for the new road surface. A binder is then added to the particle material and aggregate following which the binder, particle material and aggregate are mixed to form a surfacing mixture. The surfacing mixture is then deposited over succeeding portions of the previously planed area to form a fresh surface layer.

As described above, the aggregate may be deposited onto the area to be resurfaced prior to planing such that the aggregate and surface layer are mixed and crushed during planing. Alternatively, the aggregate may comprise particles of a predetermined size and may be added to the area to be resurfaced after the planing of the area.

In the preferred embodiment of the present method, a surface layer of the paved area is planed to provide the desired particle material and the aggregate is added either before or after planing. The binder is then deposited onto the aggregate and the particle material. The binder, aggregate, and particle material are then mixed to form a surfacing mixture. Typically the mixing includes the steps of augering the mixture to form a windrow and then mixing the material with a plurality of mixers. The surfacing mixture is then spread to a desired width by augers or other suitable devices. The surfacing mixture may then be screeded to form a fresh road surface layer. If desired, the surfacing mixture may also be leveled to a desired profile prior to screeding wherein the screed is adjusted to conform to the profile to provide suitable drainage for the roadbed.

Accordingly, the present invention provides a method and apparatus which obviates the use of heat on the road surface to prepare the road surface for scarification. The present invention further eliminates the need to pick the crushed road material up to treat it for reapplication to the road surface. Additionally, the present invention eliminates the necessity for the addition of a special hot mix or mixture to provide a new usable surface, but rather generates its own surfacing mixture at the site.

BRIEF DESCRIPTION OF THE DRAWINGS

The invention will further be illustrated by reference to the appended drawings which illustrate a particular embodiment of a road surfacing device in accordance with the present invention.

DESCRIPTION OF THE PREFERRED EMBODIMENT

Figure 2:
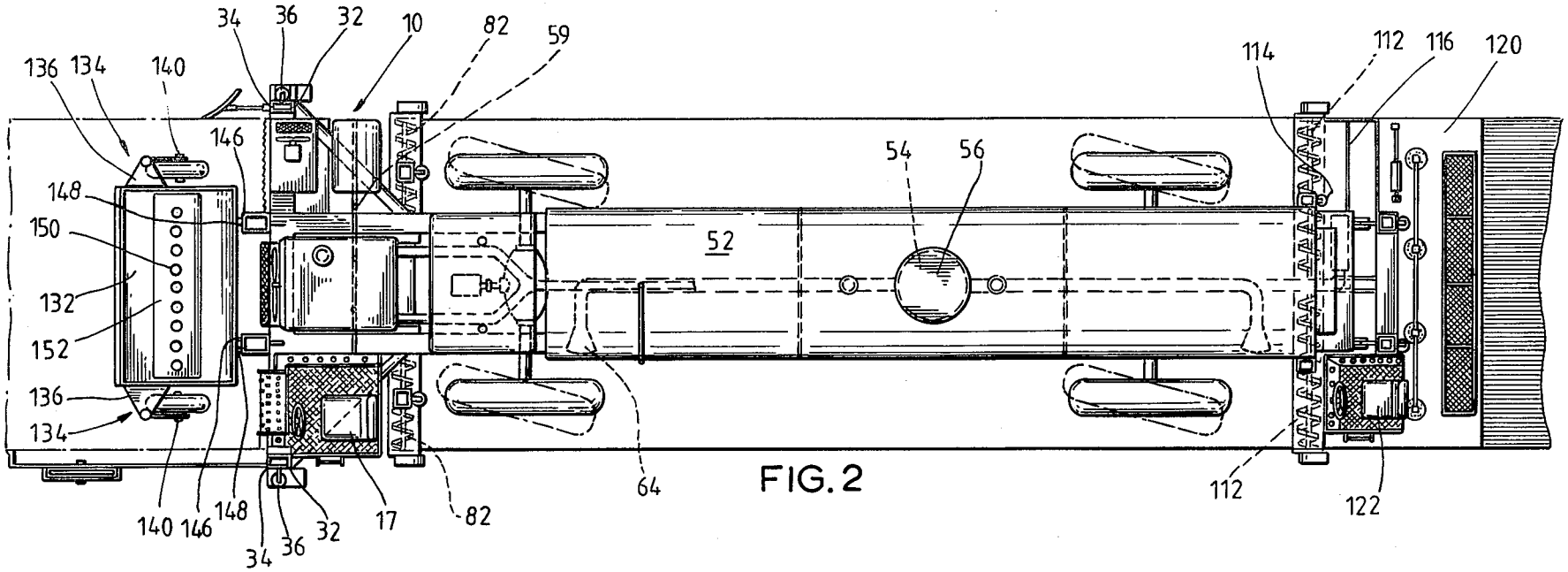
FIG. 2 is a plan view of the device illustrated in FIG. 1.

The present invention is disclosed in connection with a preferred embodiment. However it will be understood by those of skill in the art that variations from this embodiment may be taken and still be within the spirit and scope of the invention.

The preferred embodiment is generally represented by a main chassis 10 to which is mounted a planer 30, a binder dispensing system 50, a mixing system 80, a surfacing material distribution system 110 and an aggregate dispenser 130 operatively associated with the main chassis 10.

Figure 1:
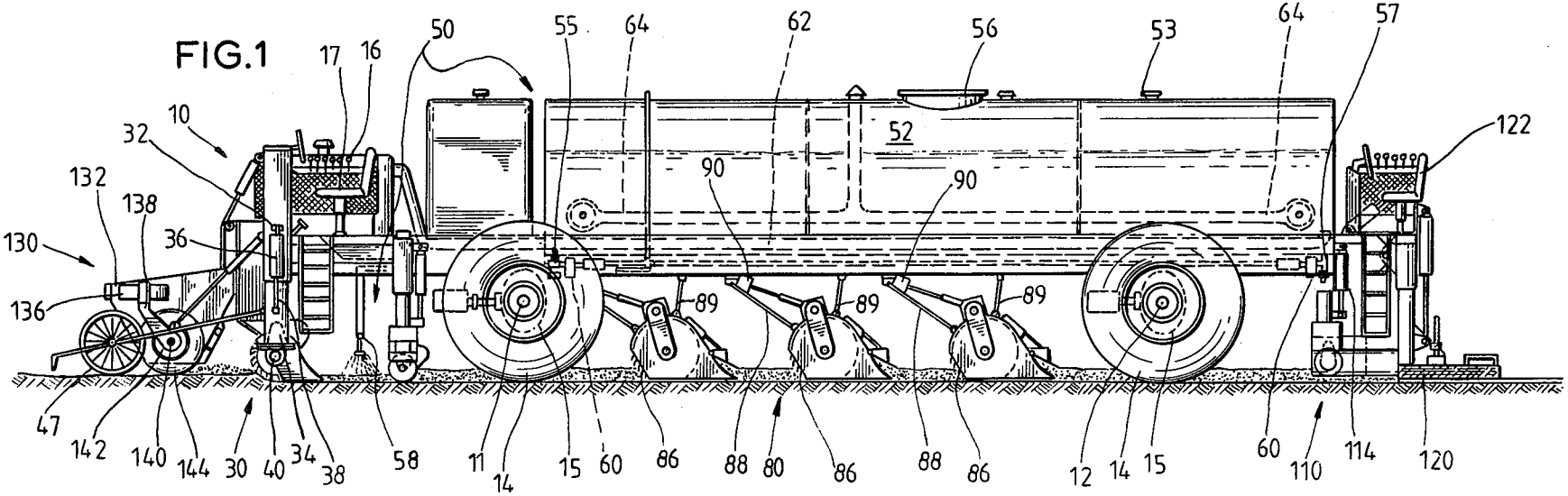
FIG. 1 is a side view of the road reclaiming device in accordance with the present invention illustrating also an aggregate dispenser suitable for depositing aggregate prior to planing.

Referring to FIG. 1, the chassis 10 is supported on a front axle 11 and a rear axle 12. Pneumatic tires 14 are mounted on the wheels 15 connected to each axle.

The chassis may include any suitable power means for driving the chassis. In the preferred embodiment, a suitable internal combustion engine 16 is utilized in conjunction with selected hydraulic pumps and hydraulic motors to operate the various systems of the road resurfacing device. The selection of the particular power train and power takeoff means is a matter of detail design mandated by the particular equipment selected to be utilized in conjunction with the present invention and is known to those of skill in the art.

In the preferred embodiment, an operator station 17 is further mounted at the front of the chassis 10 to provide visability for the operator and includes the various controls necessary for operation of the road repaving device. The operator station 17 may be enclosed and include suitable means for climate control within the enclosure.

Referring still to FIGS. 1 and 2, the planer 30 is movably mounted at the front of the chassis and extends downwardly to contact the paved area to be resurfaced. In the preferred embodiment, the planer includes opposing outer sleeves 32 mounted vertically on either side of the chassis and inner sleeves 34 movably secured within the outer sleeves 32. Adjustment of the position of the inner sleeves 34 within the outer sleeves 32 is accommodated by vertically adjusting hydraulic cylinders and pistons 36 and 38 secured between the inner sleeves 34 and outer sleeves 32 such that movement of the pistons 38 vertically adjusts the inner sleeves 34.

The planer 30 further includes a planer support axle 40 which is rotationally secured between the inner sleeves 34 along a substantially horizontal axis substantially transverse to the usual direction of travel or movement of the chassis 10. The axle 40 is operatively adapted to the power means by hydraulic motors to be rotated at a selected speed.

Figure 3:
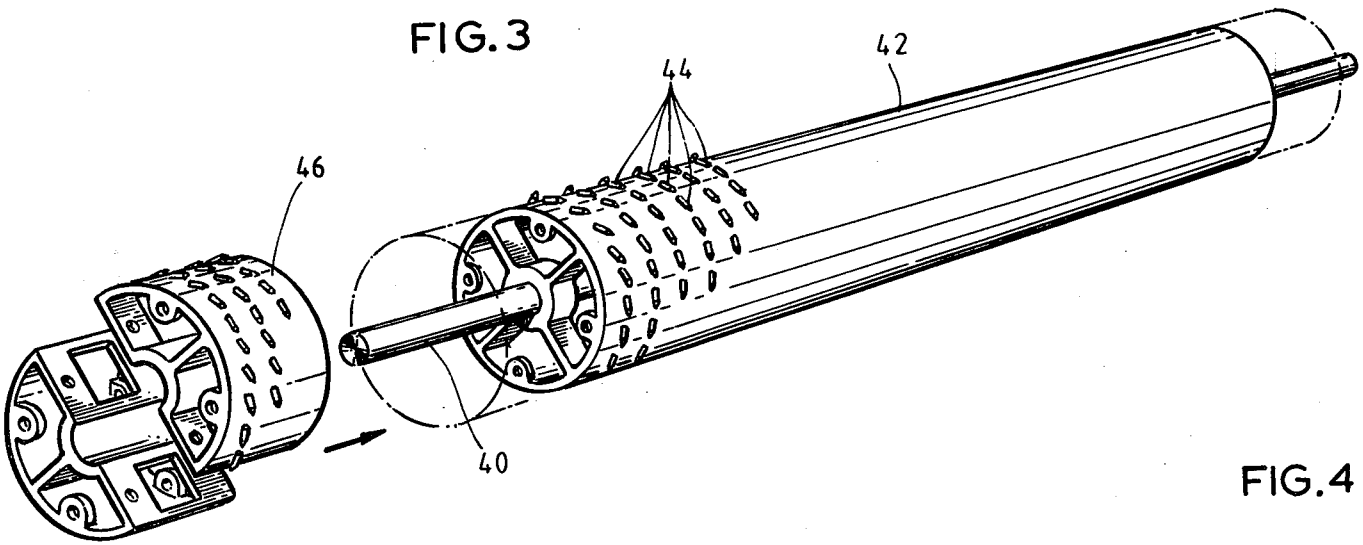
FIG. 3 is an isometric view of the planer drum assembly illustrating the removable sections.

Referring now to FIG. 3, a central cylindrical drum 42 is axially disposed around and secured to the axle 40 and includes a plurality of teeth 44 selectively positioned for planing a surface layer to provide particle material of a desired size. The planer 30 further includes in the preferred embodiment a removable cylindrical drum 46 axially disposed around the axle 40 and detachably secured to the axle 40 longitudinally adjacent the central cylindrical drum 42. The removable cylindrical drum 46 also includes a plurality of cutting teeth 44 selectively positioned for planing the surface layer to provide particle material of a desired size. In the preferred embodiment, a removable cylindrical drum 46 is included at each end of the axle 40 adjacent the central cylindrical drum 42. Accordingly, the respective removable cylindrical drums 46 may be added or detached to selectively adjust the width of cut of a paved area as desired.

Further, in the preferred embodiment, the cutting teeth 44 are detachably secured to the cylindrical drums 42 and 46 so that they may be replaced when they wear out.

In operation, therefore, the hydraulic cylinder and piston 36 and 38 are actuated to vertically adjust the position of the cylindrical drums 42 and 46 to yield a desired depth of cut. The axle 40 and cylindrical drums 42 and 46 are, in turn, adapted to the engine 16 to be rotated at a desired rpm to produce the particle size desired.

The planer 30 may further include automatic means for adjusting the rotational speed of cut of the planer 30. In the preferred embodiment, a metering wheel 47 is adapted to the chassis 10 to extend in front of the chassis 10 to engage and measure the non-planed road surface to determine the forward travel of the machine in feet per minute. The input from the metering wheel 47 is then communicated to suitable speed control means for controlling the rotational speed of the planer 30 in relation to the ground speed.

The binder dispenser system 50 includes a reservoir secured to the chassis 10 for holding a binding agent or adhesive. In the preferred embodiment, the reservoir comprises a 6300 gallon insulated oil tank 52 having a manhole sized aperture 54 at the top for inspecting and cleaning the tank. An aperture cover 56 is typically attached over the aperture to cover the aperture 54 during operation. The tank 52 further includes a filling spout 53 for loading the binding agent.

The tank 52 may further include a means for providing output of binder irrespective of the position of the tank 52 or the shifting of the binder in response to changes in the position of the tank 52. In the preferred embodiment, the tank 52 includes a front outlet aperture 55 positioned at the front of the tank 52 on the bottom of the tank 52 and a rear outlet aperture 57 positioned correspondingly at the rear of the tank 52. The front output aperture 55 and the rear output aperture 57 are interconnected such that binder flow from the tank is provided whether the tank is facing uphill or downhill.

A spray bar 58 is provided for dispensing the binder onto the aggregate and crushed material. The spray bar 58 communicates with the front and rear output apertures 55 and 57 and includes at least one aperture 59 to dispense the binding agent from the oil tank 52. Pumps 60 are further included between the spray bar 58 and the oil tank 52 to provide a pressurized flow of binding agent to the spray bar 58.

In the preferred embodiment, the spray bar 58 is positioned relative to the planer 30 and the aggregate dispenser 130 such that the spray bar 58 distributes a metered quantity of binding agent or binder onto the crushed material after the planing of the paved surface and after the depositing of the aggregate. The spray bar 58 may also be positioned, however, such that the binding agent is distributed after the aggregate and particle material is gathered as well. Additionally, multiple spray bars 58 may be included to provide a metered quantity of binding agent at the various stages of mixing.

The binder dispensing system 50 may further include a flow meter 66 (shown schematically in FIG. 4) operatively adapted to the pumps 60 to control the qunatity of binder dispensed. Alternatively, the flow may be controlled through the use of gravity and a preselected diameter of piping. In preferred embodiment, however, the pumps 60 and the flow meter 66 are used to provide the desired pressure and flow.

The binder dispensing system 50 may additionally include a means for heating the binding agent to a desired temperature to maintain it in a desired state or form. In the preferred embodiment, an exhaust pipe 62 is directed through the bottom of the oil tank 52 to provide the heat of exhaust of the engine 16 to the binding agent. A complementary heater 64 may further be provided to supply additional heat and better control of the heat if desired.

Referring again to FIGS. 1 and 2, the mixing system 80 of the present invention, includes in the preferred embodiment a pair of opposing collecting augers 82 for collecting planed roadbed and aggregate to a centralized windrow. The collecting augers 82 are mounted such that their axis of rotation is substantially horizontal and transverse to the normal direction of travel of the chassis 10. Power to the augers 82 is provided by hydraulic motors associated with the power train in a suitable manner known to those of skill in the art.

The mixing system 80 further includes three mixers 86 movably mounted to the chassis 10 for vertical adjustment to correspond to a position complementary to the depth of cut of the planer 30. In the preferred embodiment, the vertical adjustment is provided by a front linking bar 88 and a hydraulic cylinder 89 wherein each bar is pivotally mounted to the chassis 10 at one end and to the mixer 86 at the opposing end. Movement of the mixer 86 in response to contact between the mixer 86 and the planed surface is then accommodated by movement of the hydraulic cylinder 89. The rotation of the mixer 86 is controlled by a hydraulic motor 90.

In a preferred embodiment, the mixer 86 will be selected from the conventional mixers presently available. The mixer will further typically include L-shaped tines similar to the Howard Heavy Duty or EQ tines which are also readily available in the market.

The surfacing material distribution system 110 is designed to spread and level the surfacing mixture generated by the mixing system into a usable roadbed. In the preferred embodiment, the surfacing material distribution system 110 includes opposing spreading augers 112 adapted to move material outwardly from the centralized windrow to spread the material to a desired width. The spreading augers 112 are movably mounted to the chassis in a manner similar to the planer axle 40 such that the hydraulic cylinder 114 may be actuated to raise and lower the auger.

A leveling blade 116 is adjustably secured to the chassis 10 in a suitable manner known to those with skill in the art to accommodate adjustment of the blade 116 to yield the desired depth of material and the desired profile. The leveling blade 116 is positioned behind the spreading augers 112 to level the mixture once spread by the augers.

The surfacing material distribution system 110 further includes a screed 120 secured to the chassis 10 for screedding or ironing the pavement of the desired percentage of compaction. In the preferred embodiment, the screed 120 is detachably secured to the chassis 10 such that it may be lowered and unhooked to be detached from the chassis 10 when the screed 120 is not to be used in lieu of rollers or other pressing devices.

The surfacing material distribution system 110 may further include a distribution operator station 122 for controlling the raising and lowering of the screed 120 and augers 112 and for steering the rear wheels. The distribution operator station 122 may also be enclosed and climate controlled as described for the station 17.

The aggregate dispenser 130 of the present invention provides a means for distributing a metered quantity of aggregate prior to addition of the binder for the formulation of a new surfacing material at the road site. In the preferred embodiment, the aggregate dispenser 130 dispenses material prior to the planer 30 such that the planer 30 then cuts up both the aggregate and the roadbed to a desired particle size and mixes them prior to addition to the binder.

Referring again to FIGS. 1 and 2, the aggregate dispenser system 130 includes an aggregate container 132 supported on either side by opposing suspension assemblies 134. Each suspension assembly 134 includes a mounting bracket 136 secured to the side of the aggregate container 132. A support arm 138 is pivotally mounted to the bracket 136 and extends downwardly in use. An axle 140 and a wheel 142 are rotationally secured to the support arm 138 to support the aggregate container 132 for movement along with the main chassis 10.

The aggregate dispenser system 130 is operatively associated with and secured to the main chassis 10 to accommodate movement of the aggregate dispenser 130 relative to the main chassis 10 in response to variations in the height of the road surface. In the preferred embodiment, the main chassis 10 includes a pair of channels 146 secured to the chassis 10 and having a vertical orientation in use. The aggregate dispenser system 130 includes complementary flanged bearing members 148 adapted to ride within the channels 146 such that relative freedom for vertical movement between the main chassis 10 and aggregate dispenser 130 is provided.

The aggregate dispenser 130 further includes a means for accurately dispensing a quantity of aggregate onto the roadbed. In the preferred embodiment, the aggregate dispenser container 130 includes a plurality of apertures 150 positioned in the bottom of the container 132. Dispenser doors 152 are adjustably secured under the dispensing apertures 150 such that the doors may be opened to provide a desired opening to dispense a predetermined amount of aggregate.

Figure 4:
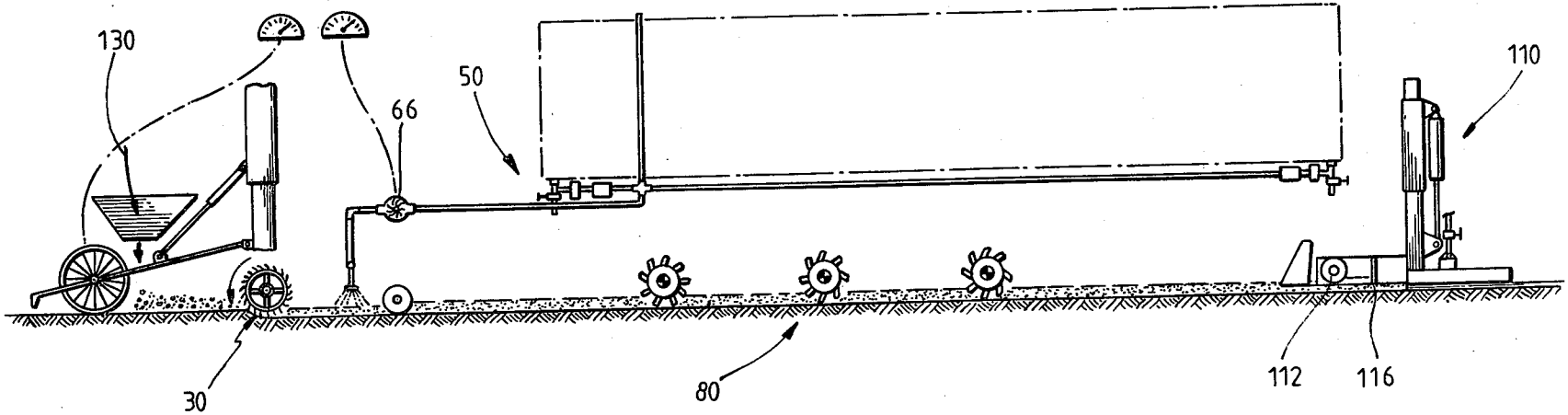
FIG. 4 is a schematic view illustrating the stages of operation of the present invention.

Referring to FIG. 4, therefore, in operation the method of resurfacing a paved area in a continuous operation includes the steps of planing with the planer 30 a surface layer of a paved area to provide particle material of a suitable size. A predetermined quantity of aggregate may be deposited either prior to planing or after planing. If deposited prior to planing, the size of the aggregate is not critical, but rather the planer 30 will crush the aggregate to a desired particle size. If deposited after planing, however, the aggrgate must include particles of a preselected size suitable for forming a new road surface.

Once the aggregate and planed particle material are deposited onto the surface, the mixing system 80 then admixes a binder distributed by the binder dispensing system 50 with the particle material and the aggregate to form a surfacing mixture on the ground. The binder may either be dispensed prior to mixing or may be dispensed simultaneously with mixing or both. Once prepared, the surfacing mixture is spread and leveled by the augers 112, the leveling bar 116 and the screed 120 over succeeding portions of the planed area to form a fresh road surface.

The instant invention has been disclosed in connection with a specific embodiment. However, it will be apparent to those skilled in the art that variations for the illustrated embodiment may be taken without departing from the spirit and scope of the invention. For example, the aggregate dispenser could be incorporated onto the main chassis and suitable allowances for the additional weight and space required could be made. Alternatively, the binder could be added during each mixing step until a desired consistency of surfacing mixture is obtained. These and other variations will be apparent to those skilled in the art and are within the spirit and scope of the invention.

What is claimed is:

1. An apparatus for surfacing a paved area, comprising:

(a) a chassis including a plurality of wheels rotatably mounted to the chassis to provide support of the chassis such that the chassis is adapted to be driven over the paved area;

(b) a planer mounted on said chassis and adapted to be rotated to plane a surface layer of the paved area, the planar including means for adjusting the width of cut by the planar;

(c) means mounted to the chassis for positioning the planar vertically for a desired depth of cut by the planar;

(d) an aggregate container operatively associated with the chassis and including a means for dispensing a desired quantity of aggregate to the paved area;

(e) a means mounted on the chassis for dispensing a predetermined quantity of a binding agent to the aggregate and particle material;

(f) a plurality of collecting augers rotationally mounted to the chassis and adapted to collect planed particle material and aggregate into a centralized windrow;

(g) means mounted on said chassis for mixing the binding agent, aggregate, and particle material to form a surfacing mixture;

(h) means mounted on the chassis for vertically adjusting the mixing means to a position complementary with the vertical position of the planar in order to insure mixing of the binding agent, aggregate and planed particle material; and (i) a means, mounted to the chassis, for spreading the mixture to a desired width to form a fresh surface layer.

2. The apparatus of claim 1 wherein the planer includes a drum having a plurality of teeth selectively positioned for planing the surface layer to provide particle material of a desired size, said drum being adapted to rotate along a substantially horizontal axis substantially transverse to the usual direction of movement of the chassis.

3. The apparatus of claim 2 wherein the planar positioning means includes a cylinder adapted between the drum and the chassis to accommodate vertical adjustment of the drum to selectively provide a desired depth of planing.

4. The apparatus of clam 1 wherein the planer comprises:

(a) an axle movably mounted to said chassis to permit rotation of the axle around a substantially horizontal axis disposed substantially transverse to the usual movement of the chassis, the axle being further movably mounted to permit selective vertical displacement of the axle for a given depth of planing; and (b) a central cylindrical drum axially disposed around and secured to said axle, said drum including a plurality of teeth selectively positioned for planing the surface layer to provide particle material of a desired size.

5. The apparatus of claim 4 wherein the width adjustment means comprises a removable cylindrical drum axially disposed and detachably secured to said axle longitudinally adjacent said central cylindrical drum, said removable cylindrical drum including a plurality of teeth selectively positioned for planing the surface layer to provide particle material of a desired size, wherein said removable cylindrical drum may be selectively removed to provide adjustability to the width of paved area planed.

6. The apparatus of claim 4 wherein the aggregate container having dimensions adequate to hold a desired quantity of aggregate, the container being connected to the chassis to accommodate for irregularities and variations in the surface of the paved area, and further comprising a metering means communicating with said container for selectively dispensing a quantity of aggregate.

7. The apparatus of claim 6 wherein said binder dispensing means includes:

(a) a reservoir for holding a binder or binding agent secured to said chassis; and (b) a spray bar communicating with said reservoir and having at least one opening for distributing a binder, the spray bar being positioned relative to the aggregate dispenser and the planar such that binder is dispensed on the aggregate and particle material.

8. The apparatus of claim 7 further comprising means for pumping a metered quantity of such a binding agent from the reservoir out of the spray bar onto the aggregate and particle material.

9. The apparatus of claim 8 wherein said mixing means includes a plurality of mixers, each mixer being adapted to be driven around a horizontal axis to mix the planed particle material, aggregate and binder to form a surfacing mixture.

10. The apparatus of claim 9 wherein said spreading means includes:

(a) a spreading auger rotationally mounted to said chassis, the spreading auger being adapted to be driven around a substantially horizontal axis to spread the surfacing mixture to a desired width over the planed area;

(b) a leveling blade adjustably secured to said chassis and disposed such that the leveling blade may be adjusted to level the mixture spread by said spreading auger to a desired profile; and (c) a screed detachably mounted proximate the rear of the chassis for screeding the leveled mixture.

11. The apparatus of claims 1 or 10 further comprising power means for driving said chassis and the systems mounted thereon.

12. The apparatus of claim 7; further comprising a means positioned in said reservoir for heating said binder in order to maintain the binder in a suitable form for application to the aggregate and particle material.

13. The apparatus of claim 1 wherein the aggregate dispensing means is adapted to deposit a selective quantity of aggregate onto the paved area prior to the planing of the surface layer.

14. The apparatus of claim 1 wherein the aggregate dispensing means is adapted to deposit a selective quantity of aggregate onto the paved area after the planing of the surface layer.

15. The apparatus of claim 1 wherein the aggregate container has dimensions adequate to hold a desired quantity of aggregate, the container being connected to the chassis to accommodate for irregularities and variations in the surface of the paved area, and further comprising a metering means communicating with said container for selectively dispensing a quantity of aggregate.

16. The apparatus of claim 1 wherein said binder dispensing means includes:

(a) a reservoir for holding a binding agent; and (b) a spray bar communicating with said reservoir and having at least one opening for distributing binder, the spray bar being positioned such that binder is dispensed on the aggregate and particle material.

17. The apparatus of claim 15 further comprising means for pumping a metered quantity of such a binding agent from the reservoir out of the spray bar under pressure.

18. The apparatus of claim 16, further comprising a means positioned in said reservoir for heating said binder in order to maintain the binder in a suitable form for application to the aggregate and particle material.

19. The apparatus of claim 1 wherein said mixing means includes a mixer positioned relative to the aggregate dispenser, the planer and the binder dispensing system such that the mixer mixes the aggregate, planed particle material, and binder to form a new surfacing mixture.

20. The apparatus of claim 1 wherein said augers are adapted to be driven around a substantially horizontal axis to gather the particle material and aggregate into a windrow.

21. The apparatus of claim 1 wherein said spreading means includes a spreading auger rotationally mounted to said chassis, the spreading auger being adapted to be driven around a substantially horizontal axis to spread the surfacing mixture to a desired width over the planed area.

22. The apparatus of claim 21 wherein said spreading means includes a leveling blade adjustably secured to said chassis and disposed such that the leveling blade may be adjusted to level the mixture spread by said spreading auger to a desired profile.

23. The apparatus of claims 1 or 22 wherein said spreading means includes a screed detachably mounted proximate the rear of the chassis for screeding the leveled mixture.

* * * * *

UNITED STATES PATENT OFFICE

CERTIFICATE OF CORRECTION

Patent No. 4,473,320 Dated September 25, 1984

Inventor(s) Archie J. Register

It is certified that error appears in the above-identified patent and that said Letters Patent are hereby corrected as shown below:

Column 7, line 67 delete "of the" and insert --to a--

Column 8, line 61 delete "aggrgate" and insert --aggregate--

Column 10, line 67 delete "of claim 7;" and insert --of claim 7,--

Signed and Sealed this

*Twenty-sixth* Day of *February 1985*

[SEAL]

*Attest:*

DONALD J. QUIGG

*Attesting Officer* *Acting Commissioner of Patents and Trademarks*